US006092630A

United States Patent [19]

Wendel et al.

[11] Patent Number: 6,092,630

[45] Date of Patent: Jul. 25, 2000

[54] ARRESTING BRAKE DEVICE FOR ELEVATORS

[75] Inventors: Peter Wendel, Würenlos; Theodor Wuest, Rüti ZH; Herbert Bachmann, Luzern; Josef Muff, Hildisrieden, all of Switzerland

[73] Assignee: Inventio AG, Hergiswil, Switzerland

[21] Appl. No.: 09/159,309

[22] Filed: Sep. 23, 1998

[30] Foreign Application Priority Data

Sep. 29, 1997 [EP] European Pat. Off. ..... 97810711

[51] Int. Cl.[7] ..... B66B 5/04

[52] U.S. Cl. ..... 187/373; 187/376

[58] Field of Search ..... 187/373, 374, 187/376, 371, 350, 359; 188/188, 189

[56] References Cited

U.S. PATENT DOCUMENTS 5,495,919 3/1996 Ericson et al. ..... 187/373
5,950,768 9/1999 Gensike et al. ..... 187/376

FOREIGN PATENT DOCUMENTS 0 432 634 6/1991 European Pat. Off. .
0 440 839 8/1993 European Pat. Off. .
805 782 of 1951 Germany .
857 264 of 1952 Germany .
27 44 986 4/1979 Germany .

*Primary Examiner*—Kenneth W. Noland
*Attorney, Agent, or Firm*—MacMillan, Sobanski & Todd, LLC

[57] ABSTRACT

An arresting brake device with triggering equipment for elevators provides different braking effect in upward and downward directions of travel. The device includes a tiltable rocker, as a barrier element, provided with an articulated two-point bearing in yielding joint pans. The rocker is operatively connected with a movable brake shoe and is, on actuation by triggering equipment, tilted by entraining members up to an abutment beyond or ahead of its dead center according to the direction of travel of an elevator car in upward or downward directions. By the tilting movement, one or the other yielding joint pan is pushed against a biased adjustable compression spring and the movable brake shoe and a fixed brake shoe are accordingly urged against a guide rail. The compression springs, which are arranged in a spring block, can each be biased separately in a variable manner by a respective setting screw.

11 Claims, 2 Drawing Sheets

ARRESTING BRAKE DEVICE FOR ELEVATORS

BACKGROUND OF THE INVENTION

The present invention concerns an arresting brake device with triggering equipment for elevators which, being guided by guide rails, move in upward and downward directions of travel and which, being monitored by a speed limiter, can be braked by this arresting brake device by a braking force, which force is different in upward and downward directions of travel, on speed limit values being exceeded.

As used herein, different braking force means that the braking force, and thus the retardation in the case of an emergency braking in an upward direction, shall be substantially smaller in the upward direction than in a downward direction for physical reasons and for reasons of human tolerability.

The simplest technical, although expensive, solution for the fulfillment of this demand consists in arranging two conventional arresting devices one above the other in opposite direction of function, as disclosed in European patent document EP 0 440 839. In this solution, abutment screws are provided, which are to enable the setting of different braking forces. It is not, however, evident from the schematic illustration, the description and the claims how a defined braking force is to result, since the oppositely disposed brake shoe and the sliding underlay are represented as rigid elements. A defined braking force can result by the available travel of the respective braking wedge together with the resilient counterforce of a brake shoe lying opposite thereto or together with the resilient counterforce of the sliding underlay of the respective brake wedge. The first solution is known from German patent document DE 27 44 986 and the second solution is known from European patent document EP 0 432 634, wherein the latter illustrates a double arresting device with two individual wedges, which lie opposite one another in reverse direction, with separate abutment screws.

As a further known constructional principle for double-acting arresting devices, those with a double eccentric are to be mentioned. Such a solution is known from the German patent document DE 805 782. According to this solution, a part denoted as a double-acting eccentric is used in the form of a circular segment with a radius which is greater than the radius of rotation. Thereby, a wedging-in of the guide rail against a spring device lying opposite thereto takes place during the moving-in, wherein the strength of the latter yields the magnitude of the braking force. The spring device is adjustable, but acts equally strongly in both directions of moving-in of the eccentric, which then also results in the same retardation values for both directions of travel.

An article in LIFTREPORT (Volume 5/91, page 38) describes an arresting brake BF×3 acting with different braking force in both directions of travel. A triggering device acting by way of a cable pull and a cable looping is operatively connected with a respective eccentric disc on each side of the elevator car. The eccentric discs have two flats that act as abutments and stop the rotational movement in the case of a triggering. On a triggering, both the eccentric discs are rotated up to these abutment surfaces in clockwise or counterclockwise sense according to direction of travel. The radius, which increases with the rotation, of the eccentric discs compresses a compression spring lying opposite, whereby the braking effect then arises. The angle of rotation is smaller for a braking in an upward direction of travel than in a downward direction of travel and the braking effect and thus the retardation are, as desired, also smaller in the upward direction. The ratio of the two braking effects in the upward direction and the downward direction of travel relative to each other is given by the geometric dimensions of the eccentric discs and can no longer be varied subsequently. The braking force is adjustable only generally by the adjustable spring. Due to the rolling path of the eccentric discs, a relatively long reaction travel results up to the full braking effect.

SUMMARY OF THE INVENTION

It is therefore the object of the present invention to create an arresting brake device of the initially mentioned kind, which has a compact constructional shape and universal possibilities of adjustment.

The invention distinguishes itself inter alia by an upwardly and downwardly tiltable rocker as a barrier element and equipment producing an unequal braking force in the upward and downward directions of travel being present. Furthermore, a short reaction travel up to the full braking effect is of advantage. The mode of construction with only singly present brake shoes and actuating elements for both directions of travel is constructionally simple and favorable to production.

The arresting brake device producing an equal braking force in upward direction and in downward direction of travel is constructed as spring-supported two-point bearing for an upwardly and downwardly tiltable rocker. The spring-supported point bearings or pivot bearings are constructed as joint pans which are displaceable against spring force with a defined position of readiness. The springs of the two point bearings or pivot bearings are each provided with a respective setting screw for the setting of the spring bias. In the position of readiness of the arresting brake device, the rocker has joint balls resting in joint pans. In the position of readiness, the brake shoes are urged by a retaining spring against abutments which after triggering of the arresting brake device also serve as abutments for the rockers.

The rocker is actuated by an entraining pin which engages into the rocker and is connected with any desired triggering equipment. The triggering equipment can in the simplest form consist of a trigger rod, which is connected with the limiter cable, with trigger lever and entraining pin. The brake shoe is articulatedly connected with the rocker. The rocker can be arranged to be tiltable over the dead center, whereby a greater security against independent falling-back results. The tilted rocker has an end position defined by an abutment. The arresting brake device can comprise one rocker or two rockers. An arresting brake device with one rocker comprises a fixed and a movable brake shoe.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
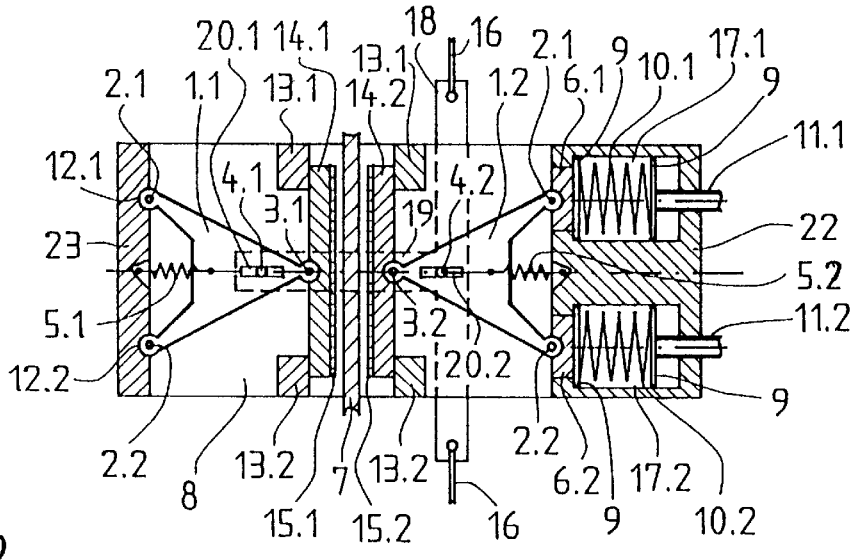
FIG. 1 is a schematic top plan view in cross-section of an arresting brake device in accordance with the present invention shown in a setting of readiness.

The arresting brake device illustrated in the FIG. 1 essentially consists of a transversely displaceable base plate 8 that is mounted in a not-illustrated car carrier construction and on which an abutment block 23 is arranged at the left and a spring block 22 at the right. Furthermore, a rocker 1.1, which is triangular in plan shape, is present at the left beside a guide rail 7 and between a brake shoe 14.1 with a brake lining 15.1 and the abutment block 23. The rocker 1.1 comprises a lowerjoint ball 2.1 and an upper joint ball 2.2, which each rest in a respective upper fixed joint pan 12.1 and a lower fixed joint pan 12.2 formed in the abutment block 23. At the tip of the rocker 1.1, this is operatively connected with the brake shoe 14.1 by means of a joint bearing 3.1. The joint balls 2.1 and 2.2 and the joint bearing 3.1 form the corner points of an approximate isosceles triangle. The outer structure of the rocker as executed in practice is not bound to the illustrated shape and can vary within wide limits as long as its intended function is ensured. In the illustrated position of readiness, the rocker 1.1 is retained by means of a retaining spring 5.1 fastened in the abutment block 23 and at the rocker 1.1. The brake shoe 14.1 in this position lies loosely against a respective double abutment above 13.1 and below 13.2 at the rear side, so that no contact with the guide rail 7 takes place during the normal elevator operation. An elongated hole 20.1, which is present on the median perpendicular of the rocker triangle, serves for the actuating engagement of an entraining member 4.1 constructed as, for example, a round pin. The entraining member 4.1 is situated on a trigger lever 19, which forms part of a T-shaped trigger rod 18, wherein the latter is coupled above and below with a limiter cable 16.

A second rocker 1.2 of like kind is arranged on the right-hand side of the guide rail 7 and is operatively connected by a joint bearing 3.2 with a brake shoe 14.2 with a brake lining 15.2. The brake shoe 14.2 is in the setting of readiness likewise leaned at the rear against the double abutments 13.1 and 13.2 for the purpose of maintaining a constant spacing from the guide rail 7 in normal operation of the elevator. Equally, an elongated hole 20.2, into which engages an entraining pin 4.2 connected with the triggering equipment, is present at the same location in the rocker 1.2. The joint balls 2.1 and 2.2 are here bedded in movable joint pans 6.1 and 6.2 respectively. A retaining spring 5.2 fulfils the same purpose as that denoted by 5.1 on the opposite side. The movable joint pans 6.1 and 6.2 rest in defined position on thrust washers 9, which in the position of readiness of the arresting brake device are urged by an upper compression spring 10.1 and a lower compression spring 10.2 against an inner abutment. The upper compression spring 10.1 is installed in an upper spring chamber 17.1 and the lower compression spring 10.2 in a lower spring chamber 17.2. The upper compression spring 10.1 can be biased in variable manner by means of an upper setting screw 11.1 by way of the second thrust washer 9. The lower compression spring 10.2 is biased in variable manner and independently of the upper one by means of a lower setting screw 11.2 by way of the second thrust washer 9.

The functions of the arresting brake device according to the invention are explained more closely in the following by reference to the FIGS. 2 and 3.

Figure 2:
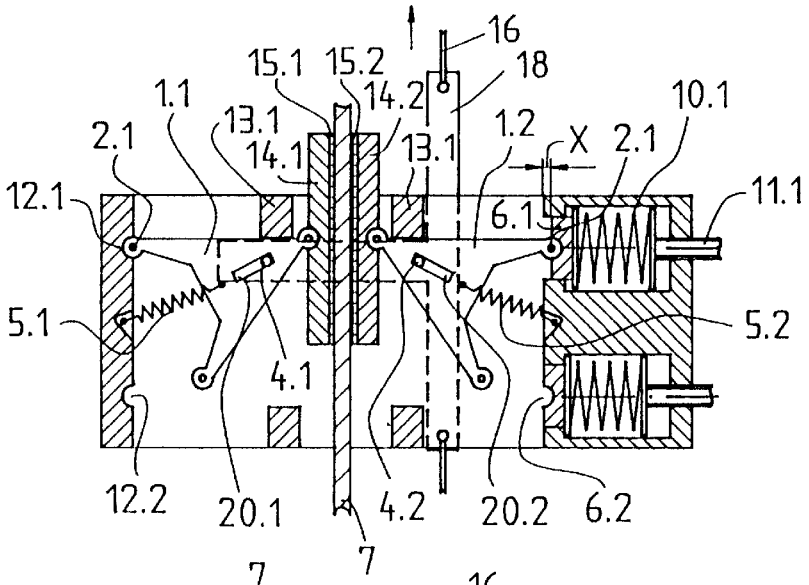
FIG. 2 is a view similar to the FIG. 1 showing the arresting brake device triggered in a downward direction of travel.

The FIG. 2 shows the engaged arresting brake device in the case of a brake-arresting action in downward direction of travel. A not-illustrated speed limiter, which is blocked for example because of excess speed, in consequence also blocks the limiter cable 16, whereby the triggering equipment 18 and 19 is moved upwardly due to the relative movement between the stationary limiter cable and the still travelling car. This movement is transmitted by means of the two entraining members 4.1 and 4.2, which engage into the elongate holes 20.1 and 20.2, to the two rockers 1.1 and 1.2, which in consequence are drawn upwardly or tilted by way of the joint balls 2.1 in the fixed joint pan 12.1 or the movable joint pan 6.1. Shortly after the beginning of the tilting movement, contact of the brake linings 15.1 and 15.2 with the guide rail 7 arises. With progressive tilting movement, the distance between the fixed joint pan 12.1 and the movable joint pan 6.1 must be able to increase due to the rocker triangles standing up, which is possible only by means of the movable, i.e. horizontally yielding, joint pan 6.1. This is pushed back into the spring chamber 17.1 by a necessary displacement distance "X" against the biased compression spring 10.1. At the same time, the arresting brake device, which is mounted to be transversely displaceable makes a centering transverse movement to the right. The change in length of the compression spring 10.1 by the amount "X" results, independently of the spring characteristic, in the brake pressure of the brake shoes 14.1 and 14.2 against the guide rail 7. The respective brake retardation can be computed in meters per second per second from the brake pressures against the arresting brake devices at both sides at the cage, the coefficients of friction of the brake linings 15.1 and 15.2, the driving or braking load in the car and the transitionally or rotationally moved masses.

According to the position of the double abutments 13.1 and 13.2, a tilting movement of the rockers 1.1 and 1.2 can be provided to ahead of or beyond their dead center position, wherein a tilting beyond the dead center position largely prevents a tilting-back and independent relaxing of the engaged arresting brake device. The end position of the tilting movement upwardly is defined by the horizontal flank of the upper double abutments 13.1. On the other hand, a relaxing of the engaged arresting brake device is facilitated by only the rockers 1.1 and 1.2 having to be tilted back by an opposite movement of the blocked car, which is substantially easier to manage than to unblock wedged arresting wedges of an arresting wedge device.

Figure 3:
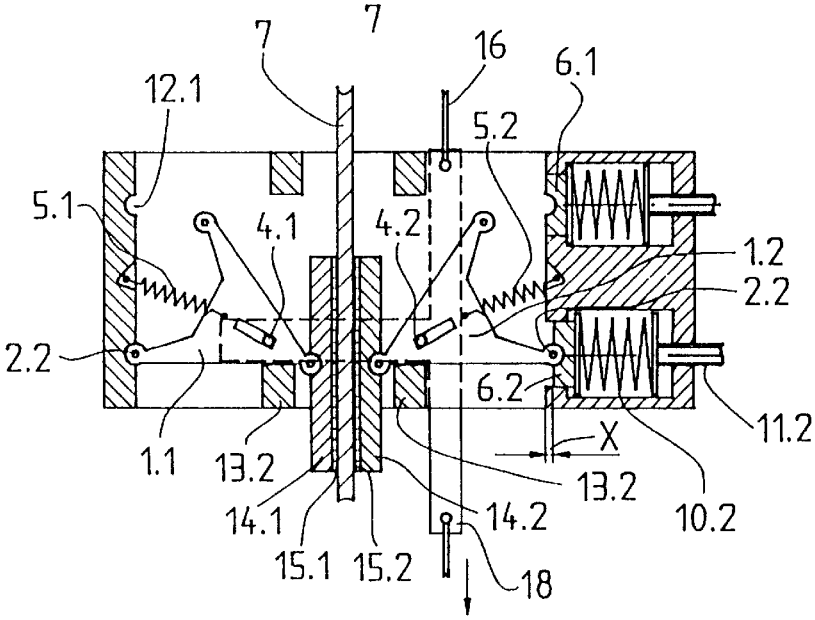
FIG. 3 is a view similar to FIG. 1 showing the arresting brake device triggered in an upward direction of travel.

The arresting brake device according to the invention is illustrated in the FIG. 3 in engaged setting in the case of an arresting braking in an upward direction of travel. In this case, the same functional sequences take place as for an arresting braking in downward direction of travel, but with downward tilting movements of the rockers 1.1 and 1.2. In that case, the biased lower compression spring 10.2 is compressed by the amount "X" by the joint ball 2.2 by way of the joint pan 6.2. For reasons mentioned 2this purpose, the lower spring 10.2 can, with possibly weaker dimension, be biased less by means of the setting screw 11.2, which accordingly results in smaller retardation values.

Figure 4:
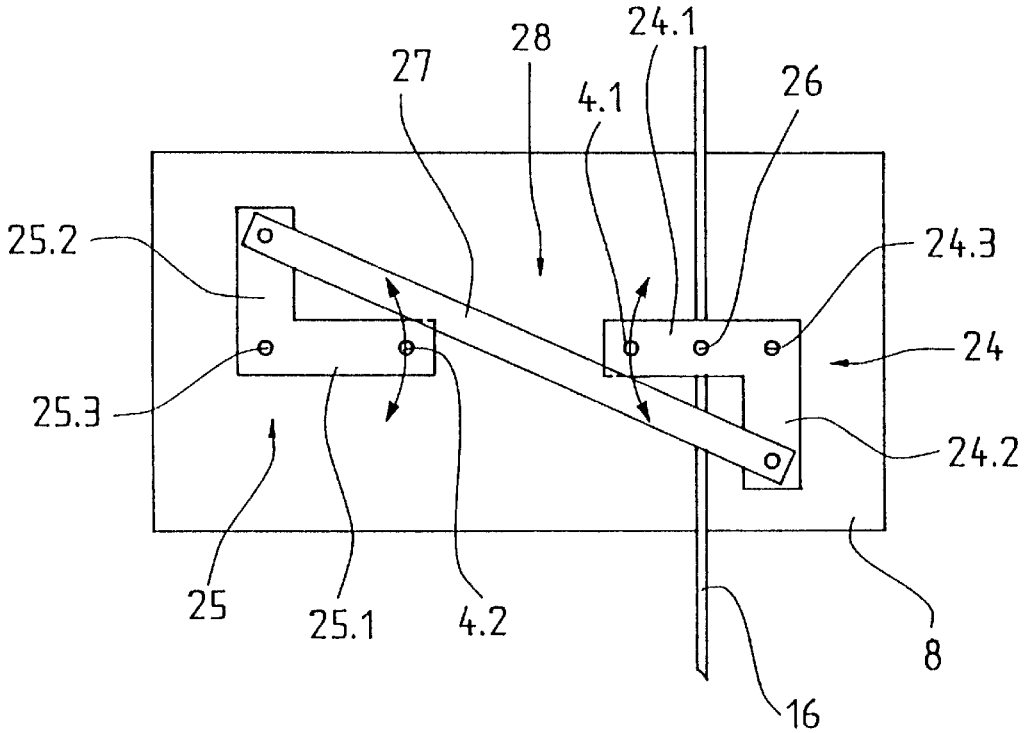
FIG. 4 is an elevational view of a triggering mechanism of the arresting brake device shown in the FIG. 1.

A variant for the triggering equipment is illustrated in the form of a lever mechanism 28 in the FIG. 4. A first angle lever 25 is arranged at the left and a second angle lever 24 is arranged at the right on the rear side of the base plate 8. The first angle lever 25 is rotationally movable about a pivot point 25.3 and carries the entraining member 4.2 at the end of its horizontal leg 25.1. A vertical limb 25.2 is articulatedly connected by its upper end with a connecting strap 27, which in turn is likewise articulatedly connected by its lower end with a lower end of a vertical limb 24.2 of the second angle lever 24. The second angle lever 24 is rotationally movable about a pivot point 24.3 and carries the entraining member 4.1 at its end of a left-hand horizontal leg 24.1. The horizontal leg 24.1 of the second angle lever 24 furthermore has a cable coupling 26 as connection with the limiter cable 16. The differently directed rotational movements of the two levers 24 and 25 during a brake-triggering cause a synchronous upward or downward movement of the two entraining members 4.1 and 4.2 and a corresponding common tilting in like direction of the two rockers 1.1 and 1.2. The pivot point 24.3 is advantageously arranged at the end of a not-illustrated connecting shaft which in the case of a triggering actuates the second parallelly operating arresting brake device on the other side of the car.

Figure 5:
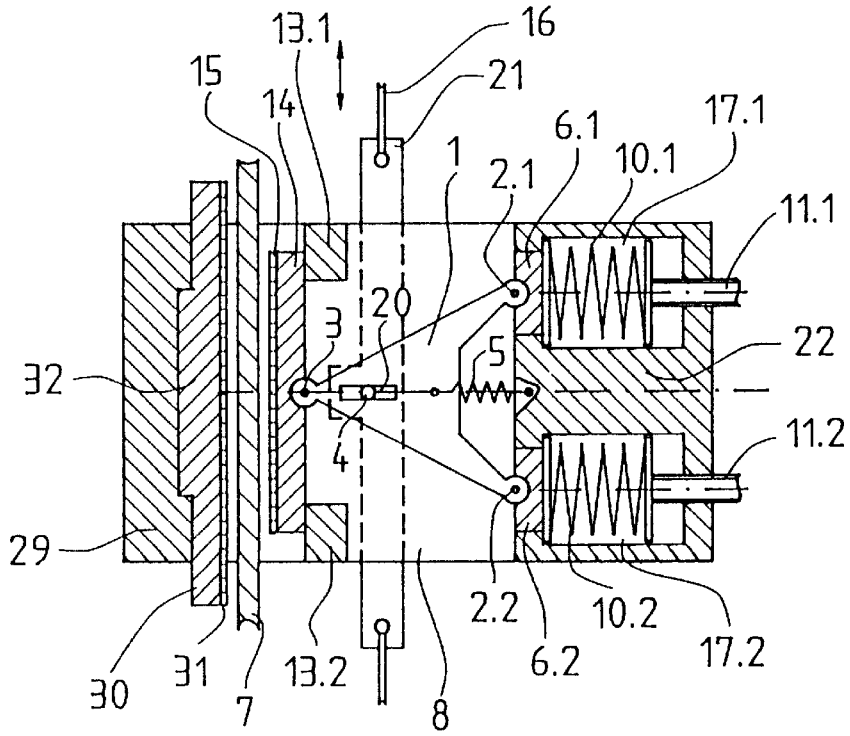
FIG. 5 is a view similar to the FIG. 1 showing an alternate embodiment of the arresting brake device according to the present invention with only one rocker.

The FIG. 5 shows a simplified construction of the arresting brake device according to the present invention. In this alternate embodiment, only a single rocker 1 with a single movable brake shoe 14 with a brake lining 15 is used. An oppositely disposed fixed brake shoe 30 with a brake lining 31 is fastened at a counterbearing 29 or is retained in a shape-locking horizontal guide 32 for the reception of the vertical thrust forces. Because an upward or a downward movement of the movable brake shoe 14 takes place on an engagement of the arresting brake device, the fixed brake shoe 30 has a greater vertical dimension in order that the horizontal projection of the movable brake shoe 14 falls as far as possible in its entire vertical length on the oppositely disposed fixed brake shoe. The horizontal displacement travel amounts only still to one half of "X" by comparison with the construction with the two rockers 1.1 and 1.2 for like dimension of the rocker 1. This loss of travel can be compensated for partially or entirely by changed geometrical dimensions of the rocker 1. This can be achieved, for example, by an increased distance between the joint balls 2.1 and 2.2 and the movable joint pans 6.1 and 6.2, as well as by possibly somewhat changed height of the triangle. Counting as significant criterion for the reliable function of the simplified arresting brake device is the initial friction of the applied movable brake shoe 14 at the guide rail 7, because a greater vertical tilting force must also be produced in the case of a greater base distance in the triangle. A simplified trigger rod 21 or the angle lever 24 is usable as triggering equipment.

The embodiments of the arresting brake device, which are shown in the figures, are illustrated simplified and schematically. They are primarily to indicate the principle of solution and the functions in easily understandable and clear manner. The construction in practice can deviate in detail to greater or lesser extent from the shown illustrations. Thus, for example, additional, possibly constrained guide elements are provided for the rockers 1, 1.1 and 1.2. Furthermore, the embodiment will in practice comprise separate abutments for the brake shoes 14 in the engaged state of the arresting brake device, which abutments absorb the relatively high vertical retardation forces during braking. Thereby, the joint bearings 3, 3.1 and 3.2 need absorb only the horizontal contact pressure forces.

Any kind of permanently elastic element with suitable characteristic can be used as the compression spring 10.1 and 10.2. For the setting screws 11.1 and 11.2, mechanical or other securing devices are provided, which reliably prevent an independent resetting of the setting screws. As a retaining spring for the rockers 1, 1.1 and 1.2, a splaying compression spring can be used in place thereof between the rockers. Bearing pins, which are led out laterally, of the joint bearings 3, 3.1 and 3.2 would, for example, be suitable as engagement points for such a compression spring.

The movable brake shoes 14, 14.1 and 14.2 with the brake linings 15, 15.1 and 15.2 are, after removal of possibly present covers, easily exchangeable through opening of the joint bearings 3, 3.1 and 3.2. The fixed brake shoe 30 can be drawn laterally out of the guide 32 after removal of the cover.

As a variant for the pin-shaped entraining members 4, 4.1 and 4.2, fork-shaped elements, which engage the rockers 1, 1.1 and 1.2 at the external outline and entrain them in the case of a triggering, can be provided for the triggering of the arresting brake device.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. An arresting brake device with triggering equipment for use with an elevator car being guided by guide rails, the elevator car being movable in upward and downward directions of travel while being monitored by a speed limiter, the elevator car being braked to standstill by the arresting brake device by a braking force, which braking force is different in upward and downward directions of travel, upon speed limit values being exceeded, the arresting brake device comprising:

at least one tiltable rocker for attachment to a speed limiter of an elevator car; and means for setting a first braking force for an upward direction of travel and for setting a different second braking force for a downward direction of travel, said means for setting being coupled to said tiltable rocker whereby when said tiltable rocker is attached to the speed limiter, said speed limiter tilts said tiltable rocker in response to the elevator car exceeding a speed limit value to apply a selected one of said first and second braking forces.

2. The arresting brake device according to claim 1 including a brake shoe connected to said tiltable rocker for engaging the guide rail when said tiltable rocker is tilted.

3. The arresting brake device according to claim 1 wherein said tiltable rocker is tiltable in up and down directions and is coupled to said means for setting by at least one spring-supported joint ball pivotally attached to a cooperating joint pan.

4. The arresting brake device according to claim 1 wherein said means for setting includes a thrust washer, a compression spring abutting said thrust washer and a setting screw engaging said thrust washer for each of said first and second braking forces.

5. The arresting brake device according to claim 1 wherein said at least one tiltable rocker is coupled to said means for setting by a first pair of joint balls pivotally attached to an associated pair of displaceable joint pans and including another tiltable rocker coupled to a base plate by a second pair of joint balls cooperating with a pair of fixed joint pans.

6. The arresting brake device according to claim 1 including a pair of abutments fixed relative to a pivot point of said tiltable rocker for limiting a tilting movement of said tiltable rocker to opposite sides of a center position.

7. The arresting brake device according to claim 1 including triggering equipment having a trigger rod for attachment to the speed limiter and at least one entraining member coupling said trigger rod with said tiltable rocker.

8. The arresting brake device according to claim 7 wherein said triggering equipment includes a trigger lever attached to said trigger rod and said at least one entraining member is attached to said trigger lever.

9. The arresting brake device according to claim 7 including another tiltable rocker for attachment to the speed limiter and wherein said triggering equipment includes a lever mechanism having a pair of angle levers connected by a connecting strap, each of said angle members being coupled to an associated one of said tiltable rockers.

10. The arresting brake device according to claim 1 including a movable brake shoe attached to said tiltable rocker, a fixed brake shoe mounted on a counterbearing, a spring block mounting said means for setting and a trigger rod for attachment to the speed limiter and coupled to said tiltable rocker.

11. An arresting brake device with triggering equipment for use with an elevator car being guided by guide rails, the elevator car being movable in upward and downward directions of travel while being monitored by a speed limiter, the elevator car being braked to standstill by the arresting brake device by a braking force, which braking force is different in upward and downward directions of travel, upon speed limit values being exceeded, the arresting brake device comprising:

a base plate for attachment to an elevator car;

at least one tiltable rocker for attachment to a speed limiter of the elevator car and being pivotally mounted on said base plate;

a brake shoe attached to said tiltable rocker for engagement with a guide rail; and means for setting a first braking force for an upward direction of travel and for setting a different second braking force for a downward direction of travel, said means for setting being mounted on said base plate and coupled to said tiltable rocker whereby when said tiltable rocker is attached to the speed limiter, said speed limiter pivots said tiltable rocker on said base plate in response to the elevator car exceeding a speed limit value to engage said brake shoe with the guide rail to apply a selected one of said first and second braking forces to stop the elevator car.

* * * * *